US005408796A

United States Patent [19]

Hashimoto et al.

[11] Patent Number: 5,408,796

[45] Date of Patent: Apr. 25, 1995

[54] WALL STRUCTURE AND RETAINER

[76] Inventors: Daniel T. Hashimoto, 561 Chamberlain Road, Burlington, Ontario L7L 2V2; Graham T. Korbey, 3250 Council Ring Road, Mississauga, Ontario L5L 1L6, both of Canada

[21] Appl. No.: 218,800

[22] Filed: Mar. 28, 1994

Related U.S. Application Data

[63] Continuation of Ser. No. 765,751, Sep. 26, 1991, which is a continuation-in-part of Ser. No. 587,680, Sep. 25, 1990, abandoned.

[51] Int. Cl.[6] ..... E04B 2/72; E04B 2/78

[52] U.S. Cl. ..... 52/489.2; 52/481.2; 52/714; 52/775

[58] Field of Search ..... 52/481, 489, 281, 282.5, 52/282.3, 359, 362, 714, 508, 509, 511, 764, 773, 774, 775, 712, 285.3; 248/71, 214, 229, 247, 300

[56] References Cited

U.S. PATENT DOCUMENTS

| | | | |
|---|---|---|---|
| 1,530,180 | 3/1925 | Holmes | 248/229 |
| 3,003,736 | 10/1961 | Hofgesang | 248/300 |
| 3,012,745 | 12/1961 | Donovan | 248/71 |
| 3,288,505 | 11/1966 | Seckerson | 52/511 |
| 3,753,325 | 8/1973 | Stanley et al. | 52/489 |
| 3,906,695 | 9/1975 | Pilgrim et al. . | |
| 3,921,253 | 11/1975 | Nelson | 248/300 |
| 3,922,764 | 12/1975 | Downing, Jr. | 52/481.2 |
| 3,998,018 | 12/1976 | Hooges | 52/481 |
| 4,094,114 | 6/1978 | Burcham | 52/481.2 |
| 4,149,353 | 4/1979 | Adams . | |
| 4,221,095 | 9/1980 | Weinar . | |
| 4,377,060 | 3/1983 | Ragland . | |
| 4,567,706 | 2/1986 | Wendt . | |
| 4,596,094 | 6/1986 | Teller et al. . | |

FOREIGN PATENT DOCUMENTS

| | | | |
|---|---|---|---|
| 885893 | 6/1943 | France | 248/300 |
| 2437519 | 5/1980 | France . | |
| 659098 | 10/1951 | United Kingdom | 52/511 |

*Primary Examiner*—Michael Safavi
*Attorney, Agent, or Firm*—Barrigar & Moss

[57] ABSTRACT

A removable wall construction system and fastener for same. Wall panels are mounted to aperture vertical studs via one-piece fasteners. The fasteners comprise a piercing means for attaching the fasteners to the edges of the wall panels, and aperture penetrators for attaching the fasteners to the studs. The aperture penetrators comprise transversely deflectable side arms or projections removably insertable into the stud apertures. These deflectable side arms are provided with inwardly bent distal end portions for improved retention in place following insertion.

23 Claims, 6 Drawing Sheets

WALL STRUCTURE AND RETAINER

RELATED APPLICATION

This is a continuation of application Ser. No. 07/765,751, filed Sep. 26, 1991, which is a continuation-in-part of U.S. patent application Ser. No. 07/587,680, filed 25 Sep. 1990, now abandoned.

FIELD OF THE INVENTION

The present invention relates to a one-piece fastener for a demountable panel construction system wherein wall panels are removably secured to a supporting structural framework by a series of fasteners attached to the edges of the wall panels, and to a system incorporating such fasteners.

BACKGROUND OF THE INVENTION

It is common to construct demountable partitions in office buildings from drywall panels. These panels are usually mounted onto vertical studs via edge fastening clips. Traditionally, these clips have been provided with prongs for attachment to the edges of the wall panel. The clips were in turn attached to the vertical studs by screws or nails. These prior clips were capable of mounting the wall panels to the supporting studs in a coplanar fashion such that the clips themselves remained hidden behind the edges of the wall panels. These wall panel clips, however, required the wall panels to be mounted to the supporting studs in a progressive fashion. Weinar, U.S. Pat. No. 4,221,095 discloses a typical wall assembly system requiring the progressive attachment of wall panels to their supporting studs, in which the clips are secured to studs by means of screws. Subsequently, clips adapted to clip onto the edges of the wall supporting studs were introduced. See e.g. Ragland, U.S. Pat. No. 4,377,060 and Wendt, U.S. Pat. No. 4,567,706, which both disclose wall fastening systems involving metal clips or fasteners which are provided with gripping flanges. Although these panel clips permitted the wall panels to be mounted to the studs in a manner permitting the easy disassembly of the wall panels, the clips often tended to slip off the supporting studs. These clips also required the wall panels to move laterally during their assembly. This significant hindrance in the assembly of partition walls, particularly at corners where lateral movement of wall panels is not possible.

Adams, U.S. Pat. No. 4,149,353 discloses a clip-type fastener that avoids some of the aforementioned problems, but the Adams fastener suffers from lack of gripping symmetry in penetrating the wall stud, and provides a resilient stud-gripping engagement along only one side thereof. This necessitates the sequential use of oppositely oriented Adams fasteners in a series of spaced stud apertures in order to balance the gripping engagement of the studs with the fasteners.

SUMMARY OF THE INVENTION

Accordingly, the present invention provides a system for constructing a removable wall from demountable wall panels. The system includes a series of vertical support means such as studs for supporting the wall panels in a coplanar arrangement. The studs have a longitudinal front face provided with spaced apertures. Fasteners are provided for fastening the wall panels by their side edges to the vertical support means. The fasteners have piercing means for engaging the side edge of the wall panel, and support attachment means comprising deformable projections for insertion into a mating aperture of the studs. The projections of the fastener are each transversely deflectable toward their central axis, i.e. their effective width can be reduced in the act of penetrating the mating aperture. These projections accordingly are dimensioned and configured to be deflected upon insertion into the apertures of the vertical support means such that once within the aperture, the projections resist removal from the aperture.

The subject system preferably comprises a series of vertical support means such as studs, each support means being vertically mounted between the floor and the ceiling, the vertical support means being horizontally separated from one another by a distance equal to the width of the standard-sized wall panels used. A row of coplanar wall panels are mounted to the vertical support means, such that the joint between two adjacent wall panels is aligned directly in front of a vertical support means.

The vertical support means may comprise a vertical member having a front face and a rear face separated by a centrally disposed web portion. The front face of the vertical support means is provided with a series of apertures located towards either side of the web portion.

Each fastener is an integral (i.e. one-piece, made from a single piece of material) fastener for engaging both the wall panel and the stud and removably attaching the panel to the stud. The fastener has rear panel edge-penetrating prongs and panel face-engaging legs or the like which, with the prongs, forms a clip-type bracket for firm gripping of the side edge of the panel, the fastener when in place being almost invisible as seen from the front of the panel.

The rear portion of the fastener is provided with an aperture penetrator for matingly penetrating any of the apertures in the stud. The aperture penetrator has spaced resilient sides each capable of flexing transversely toward the centre axis of the penetrator. The sides of the penetrator in rest position outside the aperture are spaced apart at the point of maximum width by a distance slightly exceeding the width of the aperture, so that to penetrate the aperture, the sides must flex toward the centre axis of the penetrator. This flexing creates a force of gripping engagement between the edges of the aperture and the resilient side of the penetrator.

The resilient sides of the aperture penetrator are bent toward the centre-axis of the penetrator at a point between the nose of the penetrator and the rear panel-engaging legs of the bracket, to facilitate gripping of the penetrator by the aperture.

BRIEF DESCRIPTION OF THE DRAWINGS

FIG. 3 is a top plan view of an embodiment of the fastener of the present invention.

DESCRIPTION OF THE PREFERRED EMBODIMENT

Figure 1:
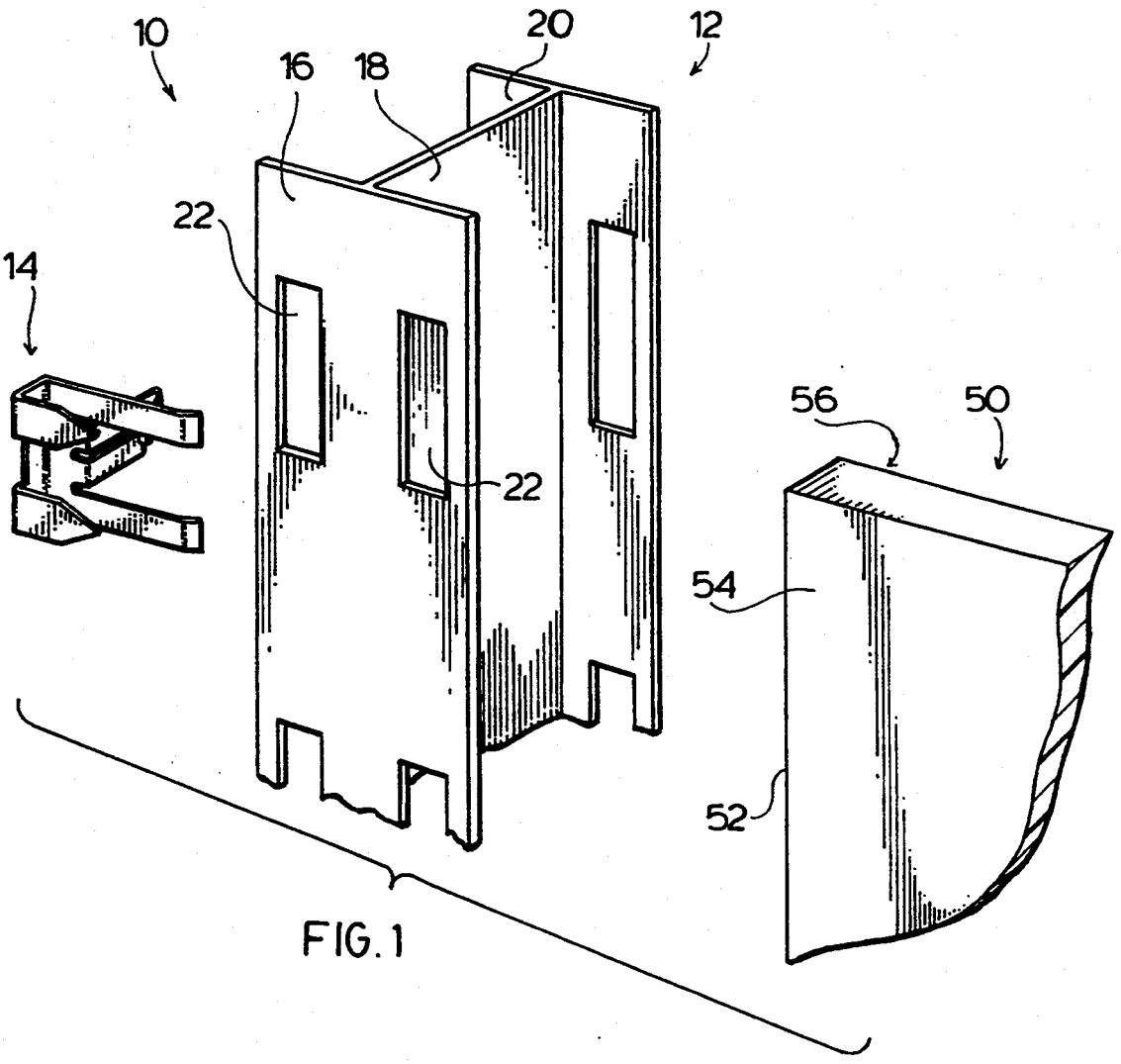
FIG. 1 is a fragmentary, perspective view of an embodiment of the wall system of the present invention.

Referring first to FIG. 1, the wall panel system of the present invention comprises vertical support means such as the stud identified generally as 12, fasteners such as the one identified generally as 14, and wall panels such as the one identified generally as 50. The stud 12 and wall panel 50 are shown only as fragments.

More specifically, the vertical support means comprises an I-shaped stud 12 having a front face 16, an intermediate web 18, and a rear face 20. The web 16 separated the faces 16 and 20 so that a space exists between front face 16 and rear face 20. Regularly spaced apertures 22 are provided on at least the front face 16 of stud 12. Desirably, for symmetry and convenience of use, identically arrayed apertures are provided on rear face 20 also. In the preferred embodiment of the present invention, the apertures 22 are formed as a series of longitudinally (vertically) spaced pairs of longitudinally extending slots, each aperture of a given pair being located on either side of web portion 18, symmetrically about the longitudinal axis of the stud 12.

Figure 3:
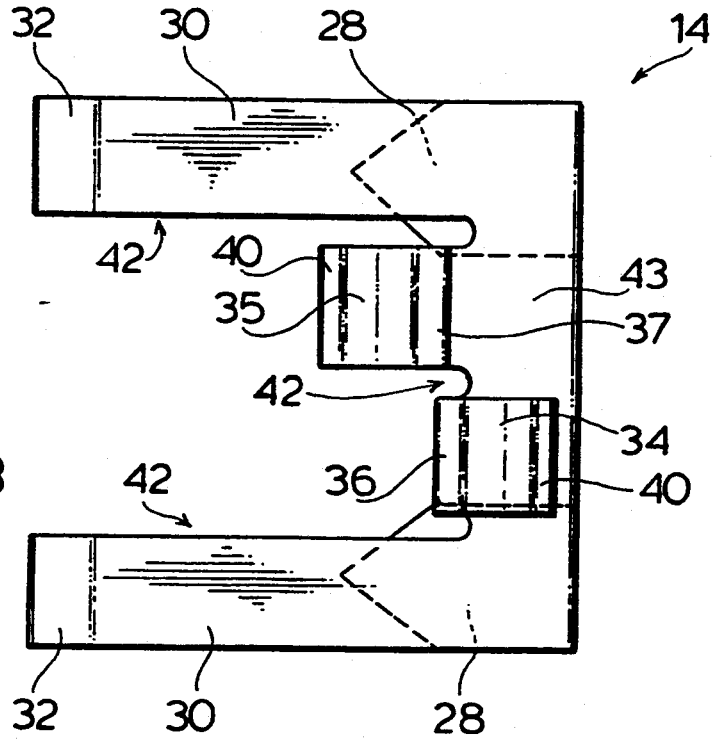
FIG. 3 is a partially cut away perspective view of an embodiment of the assembled wall system of the present invention.
Figure 4:
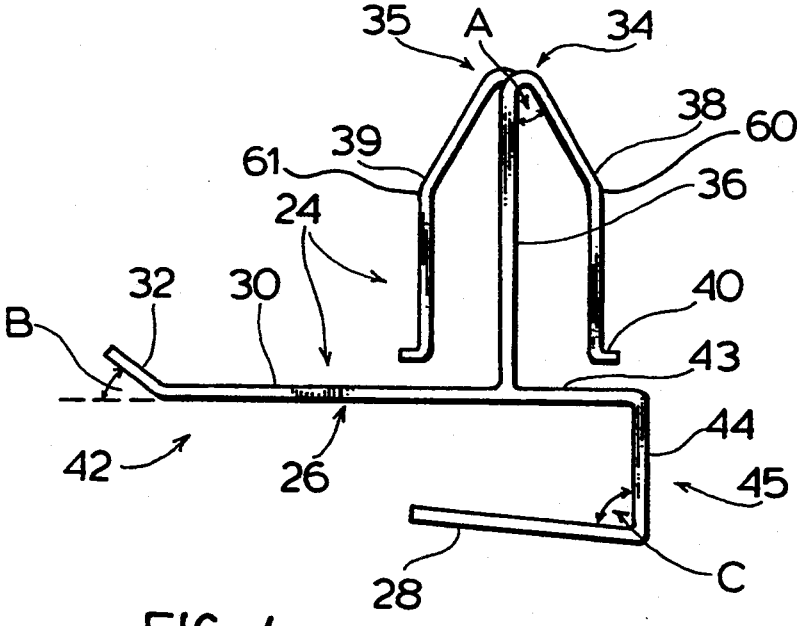
FIG. 4 is a side view of the fastener shown in FIG. 3.
Figure 5A:
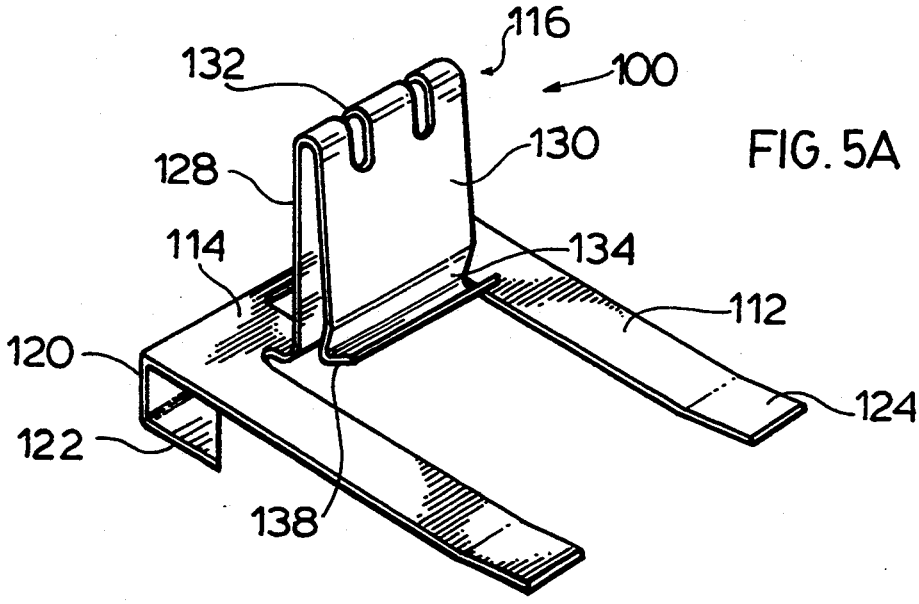
FIGS. 5A and 5B are perspective views from two different vantage points of a preferred embodiment of the fastener of the present invention.
Figure 5B:
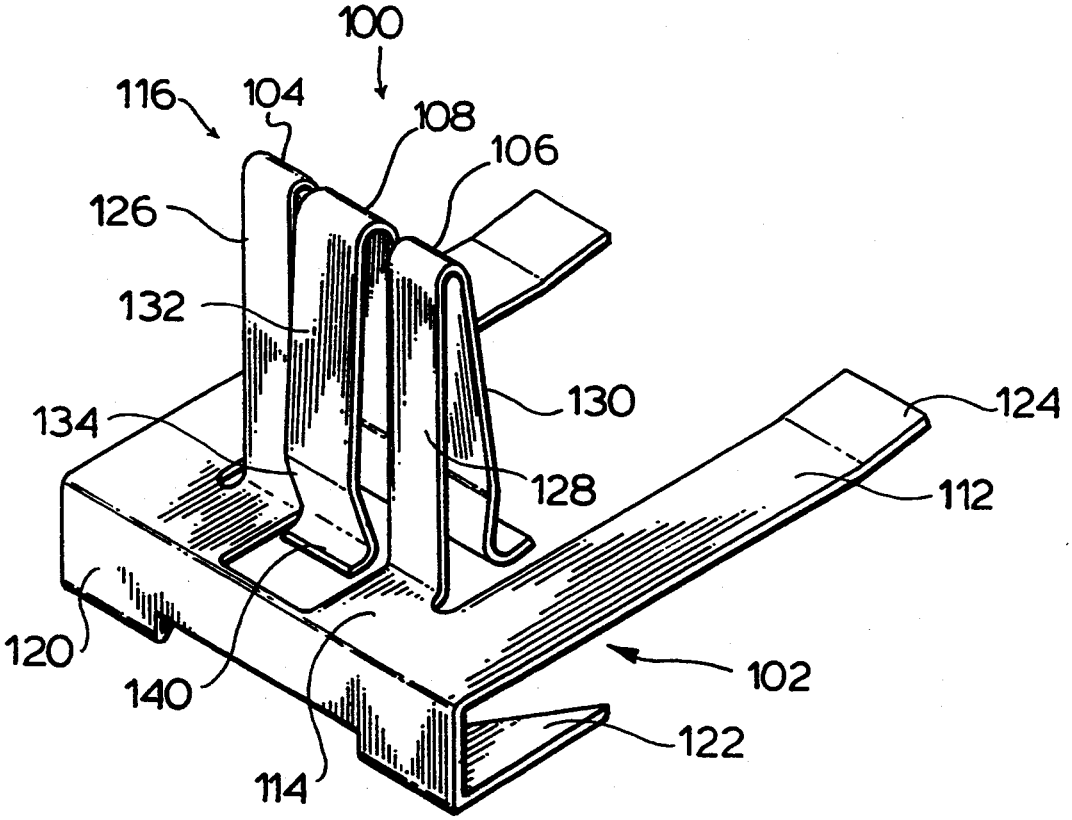
Figure 6:
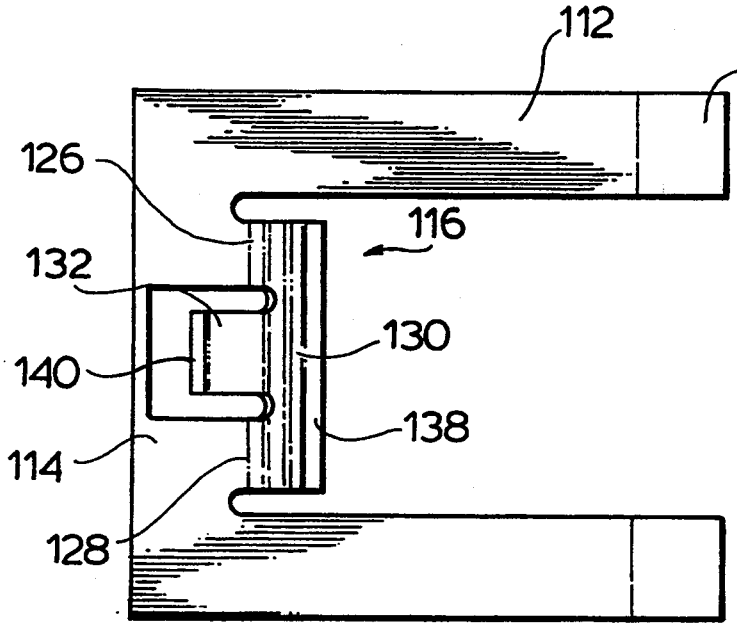
FIG. 6 is a top plan view of the fastener shown in FIG. 5A.

Referring now to FIGS. 3 and 4, the one-piece fastener 14 comprises a planar rear panel-engaging surface 42 having spaced parallel outside legs 30 whose proximal portions are integrally connected together by intermediate planar portion 43. Projecting aperture penetrator thrust bars 36 extend horizontally inwardly and generally perpendicular to planar portion 43, when inserted into the stud aperture 22.

A clip or bracket generally indicated as 45 comprises a bracket base 44, generally perpendicular to rear panel-engaging surface 42, that surface 42, and prongs 28 which extend generally parallel to leg portions 30. Leg portions 30 are provided at their distal ends with raised toes 32 which are set at angle B from the plane of leg portions 30. Prongs 28 are slightly inwardly inclined to form an acute angle C relative to bracket base 44. In the preferred embodiment of the present invention, angle C is at least about 80°.

Figure 2:
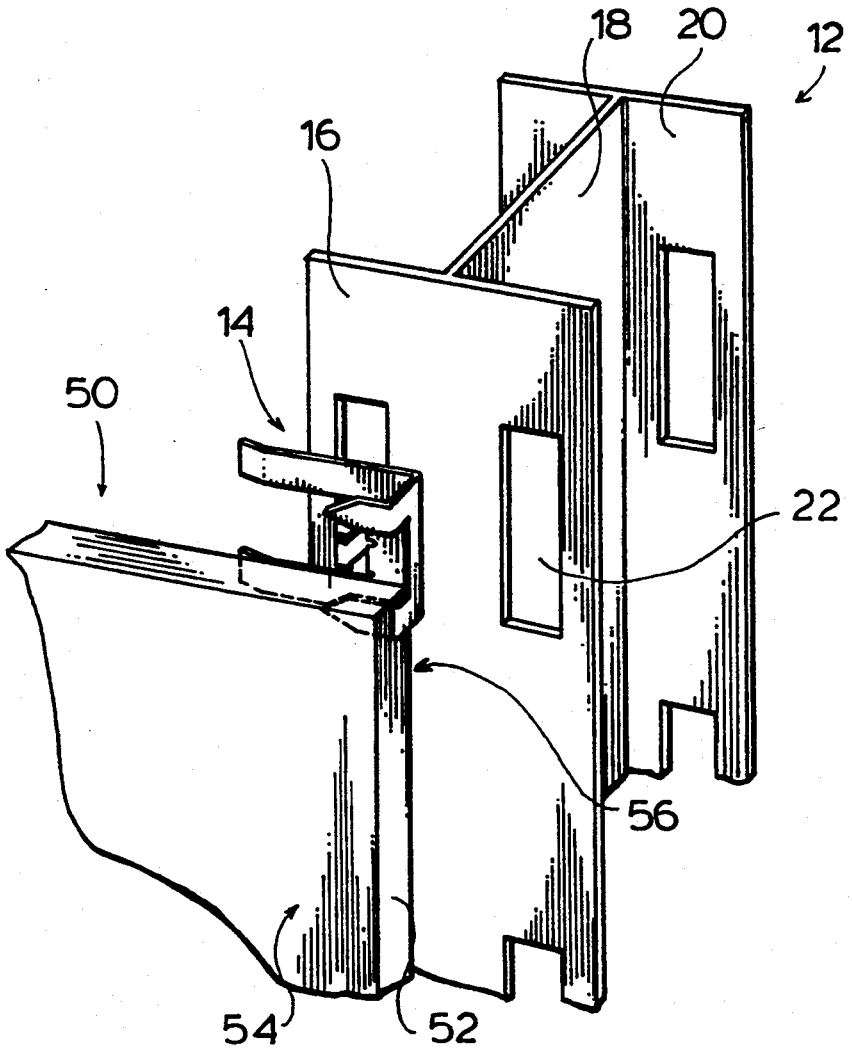

It can be seen that the bracket clip 45 can firmly grippingly engage the side wall of the panel, as illustrated in FIG. 2. The prongs 28 penetrate the side edge 52 of the panel 50 at about midway between its front and rear surfaces. The bracket base 44 in such assembled position is in planar contact with side edge 52. The rear panel-engaging surface 42 is in planar contact with the rear surface 56 of the panel 50.

Another way of looking at the bracket clip 45 is to perceive it as comprising at each end a thumb and extended finger in gripping configuration, the thumb being a prong 28, and the finger being a leg 30. The thumb (prong) 28 penetrates the side edge of the panel whilst the finger (leg) 30 affords vertical stability by snugly pressing against the rear surface 56 of the panel 50.

Projections or thrust bars 36, 37 of aperture penetrators 35 are integral extensions of intermediate planar surface 43. Thrust bars 36, 37 project rearwardly from planar panel-engaging surface 42, between legs 30. The two thrust bars 36, 37 are spaced from one another. At their distal ends, noses 34 are formed that continue as flexible resilient side elements 38, 39 respectively. The noses 34 form about a relatively sharp acute angle A. The resilient arms 38, 39 are bent transversely inwardly toward the centre axis of the penetrator (in line with thrust bars 36, 37) at 60, 61. Thus the free distal ends of the resilient arms 38, 39 tend to grippingly engage the apertures 22 when they are inserted therein. These distal ends of arms 38, 39 terminate in transverse extensions or flanges 40.

The manner of use of the fastener 14 is apparent by reference to FIG. 2. To assemble the wall panel system, fasteners 14 are first attached to a wall panel 50 at side edge 52 thereof as illustrated in FIG. 2. The toes 32 slightly splayed outwardly facilitate positioning the fastener 14 against rear face 56 of panel 50. Prongs 28 are driven into edge 52 of panel 50 such that rear surface 56 of wall panel 50 presses against leg portions 30. Side edge-contacting bracket base 44 of fastener 14 touches the edge 52 of wall panel 50 when prongs 28 are fully inserted. Fasteners 14 are fastened to wall panel 50 such that when rear face 56 of wall panel 50 is brought towards front face 16 of vertical support means 12, projections 34 and 35 of fasteners 14 are aligned with associated mating apertures 22. The aperture penetrators 35 are then forcibly inserted into apertures 22. In this position, side edge-contacting bracket base 44 of each of the fasteners 14 is aligned with the central axis of front face 16 of stud 20. The diameter width of apertures 22 is less than the maximum distance between arms 38 and 39 of fastener 14. Upon insertion, arms 38 and 39 are deflected transversely inwardly towards thrust bars 36, 37 respectively. The aperture penetrators 35 enter associated apertures 22 until the portions of front face 16 adjacent the apertures 22 engage transversely extending flanges 40 located at the distal ends of resilient arms 38 and 39. Those portions of the arms 38 and 39 which lie behind front face 16 then tend to bulge transversely outwardly away from the distal ends of arms 38, 39. This "recoil" of arms 38 and 39 results in their exerting a gripping force against the front face 16 near apertures 22 which in turn tends to retain the aperture penetrators 35 in place within apertures 22.

If lateral movement of wall board 50 occurs during the assembly of the wall system, and the flexibility of the aperture penetrators 35 admits a limited amount of accommodation.

To create a continuous wall, a series of wall boards 50 are attached to a series of vertical studs 12 such that the side edges 52 of adjacent wall boards abut one another directly in front of an associated stud 12.

To disassemble the wall construction, a specific wall panel may be removed by pulling the panel outward at panel edge 52 away from the vertical support means 12 with sufficient force to deflect the arms 38, 39 towards their associated thrust bars 36, 37. This forces the aperture penetrators 35 to exit their associated apertures 22 and, therefore, release the wall panel 50 from stud 12. This procedure is repeated with each fastener 14 located along side edges 52 of wall panel 50.

In the preferred embodiment, a partition wall may be constructed from a single series of studs 12 by parallel mounting of a pair of wall panels 50 to front face 16 and to rear face 20 respectively of stud 12 via a plurality of fasteners 14.

Referring to FIGS. 5A, 5B, 6 and 7, one-piece fastener 100 includes spaced bracket clips 102 each made up of a leg 112, prong 122 and an intermediate bracket base 120. Fastener 100 also comprises and aperture penetrator 116 extending away from intermediate planar portion 114 and generally perpendicular to legs 112. Legs 112 are provided at their distal ends with splayed toes 124 which are at a slight outward angle to the plane of the legs 112.

Aperture penetrator 116 includes thrust bars 126 and 128 extending perpendicular to legs 112. A wide resilient member 130 forms a reverse-angled nose at spaced nose portions 104,106 constituting respective continuations of thrust bars 126 and 128. In the preferred embodiment, a narrower central resilient member 132 is located between thrust bars 126 and 128, and extends as a continuation of a central portion of wide resilient member 130 about reverse-angled central nose portion 108 and thence forwardly to the other side (in a transverse sense) of thrust bars 126 and 128. Nose portions 104, 106, 108 are aligned so that they function as a single thrusting entity when penetrating an associated aperture 22.

Figure 7:
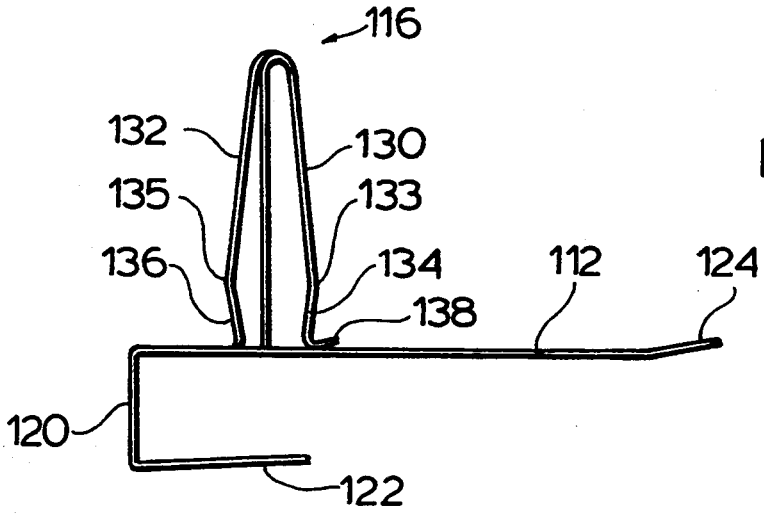
FIG. 7 is an elevation view of the fastener shown in FIG. 5A.

As best shown in FIG. 7, resilient members 130 and 132 are bent transversely inwardly at 133 and 135 respectively. They terminate distally in lips or flanges 138,140 at the distal ends 134 and 136, which are slightly inwardly inclined relative to thrust bars 126 and 128.

Resilient arms 130,132 are transversely deflected when they are inserted into a stud aperture 22. Upon insertion of penetrator 116, resilient members 130 and 132 are deflected toward each other due to the fact that the maximum width of penetrator 116 at 133, 135 is greater than the width of the aperture 22. With the relative dimensions illustrated, resilient member 130 is not deflected to the same extent as resilient member 132. During insertion, resilient members 130 and 132 each press against the edge of the aperture with a transverse force approximately perpendicular to the longitudinal central axis of aperture penetrator 116. Because of the balanced symmetrical configuration and relative location of the resilient members 130, 132, the transverse force created by deflection of the wide resilient member 130 is balanced by the transverse force created by deflection of the narrow resilient member 132; therefore, torsion of the projection does not occur. This is in contrast to the fastener 14 of FIG. 3, which because of the lack of symmetry along the central axis of the aperture penetrator is subject to torsional forces.

The bends at 133 and 135 of resilient members 130, 132 permit the portions of resilient members 130 and 132 which are behind the stud aperture 22 to partially "recoil" away from each other after insertion such that the width of the penetrator 116 behind the aperture 22 is wider than the width of the aperture 22 itself. The recoil of resilient members 130 and 132 results in a gripping engagement force being applied by aperture penetrator 116 to the front face of the stud 12 adjacent the aperture 22. This longitudinally acting force (relative to the aperture penetrator axis) resists the removal of penetrator 116 from the aperture 22 and thereby maintains penetrator 116 in place within the aperture. Stop lips 138 and 140 engage the front face of the stud 12 adjacent the aperture 22 so as to prevent resilient members 130 and 132 from being fully inserted into the aperture. With resilient member 130 and 132 being only partially inserted into the aperture, removal of penetrator 116 from the aperture can be achieved by applying an outwardly directed force to the fastener, said force being of sufficient magnitude to overcome the longitudinal gripping force exerted by penetrator 116.

In an alternative embodiment (not shown), penetrator 116 may take the form of three or more separate projections each having a portion perpendicular to the legs 112 and a resilient member, the resilient members being so arranged that upon insertion of the penetrator, the transverse forces created by the resilient members pressing against the edges of the aperture are balanced and no torsion of the projection occurs.

Figure 8:
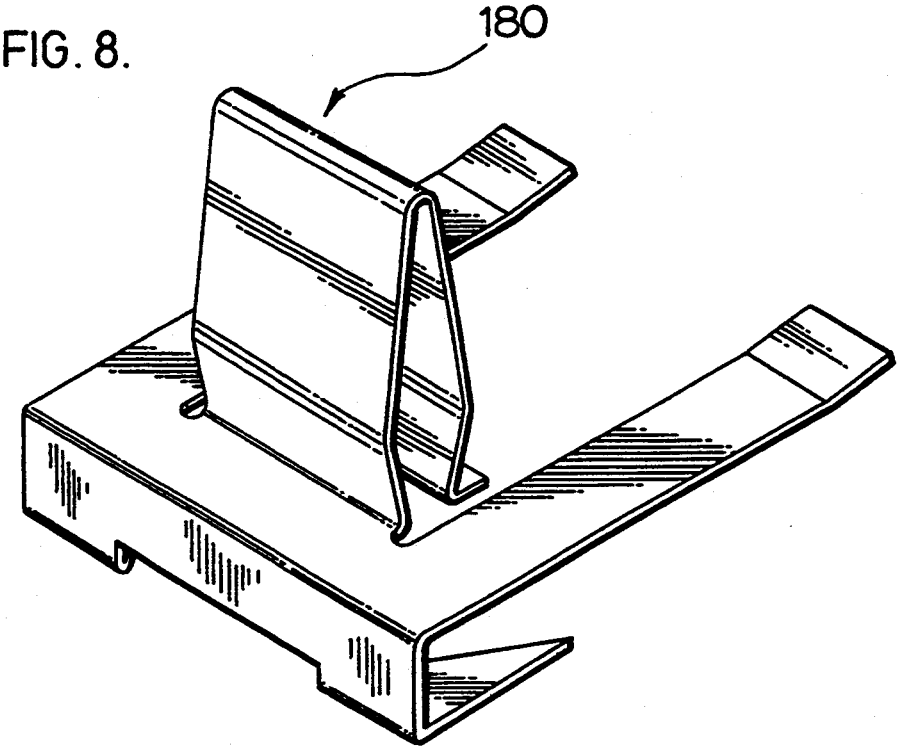
FIG. 8 is a perspective view of an alternative fastener incorporating some of the characteristics of the fastener of FIG. 5A, but which is considered to be inferior in structure to the fastener of FIG. 5A.
Figure 9:
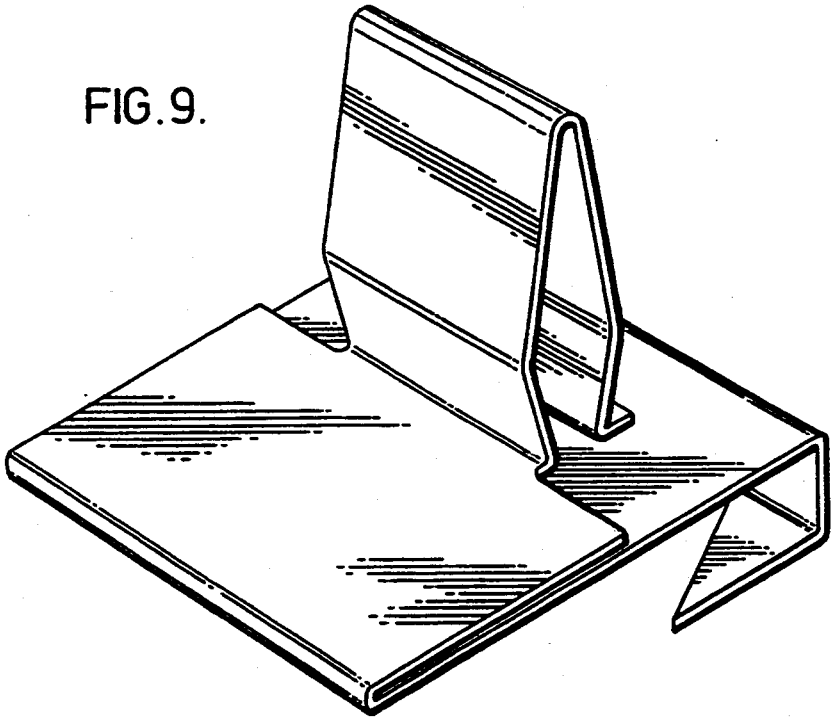
FIG. 9 is a perspective view of a further alternative fastener incorporating some of the characteristics of the fastener of FIG. 5A, but which is considered to be inferior in structure to the fastener of FIG. 5A.

Further alternative structures are illustrated in FIGS. 8 and 9. FIG. 8 illustrates a one-piece fastener generally similar to that of FIG. 5A except having a single continuous folded sheet portion as the aperture penetrator 180, as illustrated. The structure of FIG. 8 is considered inferior to that of FIG. 5A, because the relative flexibility of one side of the penetrator, joined to the bracket clip, is less than that of the other, whose distal end is free.

FIG. 9 illustrates a further one-piece fastener whose overall configuration is similar to that of FIG. 8, but which is formed by doubling the sheet material (typically steel) of which the fastener is made about the distal end of the toe of the leg.

The FIG. 9 embodiment is less desirable than that of FIG. 8, since it requires the use of a greater amount of material; further, it may be unduly stiff.

In other alternative embodiments of the present wall construction system, stud 12 may assume a shape other than an I-beam, provided that it comprises a front face and a web portion arranged so as to create a space directly behind the front face in order to receive projections 34 and 39 of fastener 14. For example, the support means could be a C-shaped member having front and rear surfaces, a Z-shaped member having front and rear surfaces, or a T-shaped member having only a front face. Apertures 22 may be circular or oval in some embodiments, while in other embodiments of the present invention, apertures 22 may not be oriented in pairs.

If the side edge 52 of the panel 50 were provided with spaced slots, prongs 28 could be replaced by tongues removably engaging such slots.

While the present invention has been described and illustrated with respect to the preferred embodiments, it will be appreciated that further variations of the preferred embodiments may be made without departing from the subject invention, the scope of which is defined in the appended claims.

What is claimed is:

1. A wall system comprising: a plurality of panels having parallel sides; a plurality of substantially identical studs each having a vertical array of closely spaced pairs of substantially identical slotted apertures through a front surface thereof for receiving fasteners; and a plurality of substantially identical integral fasteners gripping and retaining the panels in place in a vertical coplanar contiguous array against the studs, each said fastener having:

(a) a panel edge-contacting bracket base positioned against a side edge of a panel;

(b) a pair of spaced panel-gripping and retaining bracket clips, each formed at a respective end of the bracket base, each having a generally rectangular U-shaped configuration, the trough of the U comprising a respective end portion of the bracket base, and the legs of the U formed by a front thumb and a rear finger extending in the same sense generally perpendicularly to the plane of the bracket base, the thumb penetrating the side edge of the panel, the bracket clips gripping and retaining the panel along a side edge thereof;

(c) an intermediate planar portion located between the bracket clips and extending generally perpendicular to the bracket base coplanar with the fingers of the clips;

(d) an aperture penetrator projecting into said structural element aperture, offset from the bracket base and including:

(i) a pair of spaced thrust bars, the proximal portion of each formed as a continuation of said intermediate planar portion and extending generally parallel to the bracket base;

(ii) a first dependent resilient element formed as a continuation of both of the thrust bars about reverse-angled noses at the distal ends of the thrust bars;

(iii) a central portion of said first resilient element being continued as a second dependent resilient element about a reverse angled nose intermediate and spaced from the thrust bar noses; said second dependent resilient element extending from its associated nose at a sharp acute angle to the plane of the thrust bars on a side of the thrust bars opposite to that of the first dependent resilient element;

(iv) said first and second resilient elements each having a forward distal portion bent inwardly toward the thrust bars; and (v) said resilient elements being configured and dimensioned so that the maximum spacing therebetween in a transverse sense slightly exceeds the width of said structural element aperture, whereby the resilient elements deflect inwardly as the penetrator enters the aperture, and the penetrator upon entry into the aperture is removably retained therein and wherein the slots in each pair of slots are spaced from one another by approximately twice the offset spacing between the bracket base and the penetrator of each said fastener.

2. A wall system as defined in claim 1, wherein each of the studs is of I-shaped horizontal cross section, the pairs of apertures including one aperture on either side of the vertical axis of the stud through the front surface thereof.

3. A wall system comprising: a plurality of panels having parallel sides; a plurality of substantially identical studs each having a vertical array of closely spaced pairs of substantially identical slotted apertures through a front surface thereof for receiving fasteners; and a plurality of substantially identical integral fasteners gripping and retaining the panels in place in a vertical coplanar contiguous array against the studs, each said fastener having:

(a) a panel edge-contacting bracket base positioned against a side edge of the panel;

(b) a pair of spaced panel-gripping and retaining bracket clips, each formed at a respective end of the bracket base, each having a generally rectangular U-shaped configuration, the trough of the U comprising a respective end portion of the bracket base, and the legs of the U formed by a front thumb and a rear finger extending in the same sense generally perpendicularly to the plane of the bracket base, the thumb penetrating the side edge of the panel, the bracket clips gripping and retaining the panel along a side edge thereof;

(c) an aperture penetrator projecting into a stud aperture, offset from the bracket base and including:

(i) thrust bar means connected to and extending generally rearwardly from and parallel to the bracket base;

(ii) a dependent resilient element continuing from the thrust bar means via reverse angled nose means, said dependent resilient element extending outwardly from the thrust bar means;

(iii) said resilient element having a free distal portion bent inwardly toward the thrust bar means; and (iv) said resilient element being configured and dimensioned so that the maximum spacing between said resilient element and the thrust bar means in a transverse sense slightly exceeds the width of said structural element aperture, whereby the resilient element deflects inwardly as the penetrator enters the aperture, and the penetrator upon entry into the aperture is removably retained therein.

4. A wall system as defined in claim 3, wherein each of the studs is of I-shaped horizontal cross section, the pairs of apertures including one aperture on either side of the vertical axis of the stud through the front surface thereof.

5. A wall system comprising: a plurality of panels having parallel sides; a plurality of substantially identical studs each having a vertical array of closely spaced pairs of substantially identical slotted apertures through a front surface thereof for receiving fasteners; and a plurality of substantially identical integral fasteners gripping and retaining the panels in place in a vertical coplanar contiguous array against the studs, each said fastener having:

(a) a bracket means gripping and retaining a side edge of a panel, said bracket means having a generally rectangular U-shaped configuration, the trough of the U forming a panel edge-contacting bracket base positioned against a side edge of the panel, and the legs of the U grippingly engaging the panel;

(b) an aperture penetrator projecting into a stud aperture, offset from the bracket base and including:

(i) thrust bar means connected to and extending generally rearwardly from and parallel to the bracket base;

(ii) a pair of dependent resilient elements extending outwardly from the thrust bar means via reverse angled nose means, on opposite sides of the thrust bar means;

(iii) said resilient elements each having a forward distal portion bent inwardly toward the thrust bar means; and (iv) said resilient elements being configured and dimensioned so that the maximum spacing therebetween in a transverse sense slightly exceeds the width of said structural element aperture, whereby the resilient elements deflect inwardly as the penetrator enters said aperture, and the penetrator upon entry into the aperture is removably retained thereby.

6. A wall system comprising: a plurality of panels having parallel sides; a plurality of substantially identical studs each having a vertical array of closely spaced pairs of substantially identical slotted apertures through a front surface thereof for receiving fasteners; and a plurality of substantially identical integral fasteners gripping and retaining the panels in place in a vertical coplanar contiguous array against the studs, each said fastener having:

(a) a bracket grippingly engaging a side edge of a panel, the bracket having a generally rectangular, U-shaped configuration, the trough of the U being a panel edge-contacting bracket base positioned against a side edge of the panel, and the legs of the U grippingly engaging the panel; and (b) an aperture penetrator formed as a continuation of the bracket and protruding rearwardly therefrom, and projecting into the structural element aperture, said aperture penetrator comprising spaced thrust bars and resilient elements outwardly flared therefrom each in a different transverse sense from the thrust bars, and each resilient element being bent distally in an inward sense to reduce the amount of flare that would otherwise exist.

7. A fastener for fastening a panel to a structural element having a slot-like aperture with a predetermined width, the fastener being adapted to be received in said aperture, comprising:

(a) a panel edge-contacting bracket base for positioning against a side edge of the panel;

(b) A pair of spaced panel-gripping and retaining bracket clips, each formed at a-respective end of the bracket base, each having a generally rectangular U-shaped configuration, the trough of the U comprising a respective end portion of the bracket base, and the legs of the U formed by a front thumb and a rear finger extending in the same sense generally perpendicularly to the plane of the bracket base, the thumb being configured to penetrate the side edge of the panel, the bracket clips being configured and dimensioned to grip and retain the panel along a side edge thereof;

(c) an intermediate planar portion located between the bracket clips and extending generally perpendicular to the bracket base coplanar with the fingers of the clips;

(d) a penetrator adapted for matingly thrusting into said structural element aperture, offset from the bracket base and including:

(i) a pair of spaced thrust bars, the proximal portion of each formed as a continuation of said intermediate planar portion and extending generally parallel to the bracket base;

(ii) a first dependent resilient element formed as a continuation of both of the thrust bars about reverse-angled noses at the distal ends of the thrust bars;

(iii) a central portion of said first resilient element being continued as a second dependent resilient element about a reverse angled nose intermediate and spaced from the thrust bar noses; said second dependent resilient element extending from its associated nose at a sharp acute angle to the plane of the thrust bars on a side of the thrust bars opposite to that of the first dependent resilient element;

(iv) said first and second resilient elements each having a forward distal portion bent inwardly toward the thrust bars; and (v) said first and second resilient elements being configured and dimensioned so as to have a spacing therebetween, whereby said first and second resilient elements are adapted to deflect inwardly as said penetrator enters said aperture, and said penetrator upon entry into said aperture is removably retained therein.

8. A fastener as defined in claim 7, made from a single piece of stiff, strong, resilient, relatively thin sheet material.

9. A fastener as defined in claim 7, made from a single piece of sheet steel.

10. A fastener as defined in claim 8, wherein the distal portions of the resilient elements terminate in short flanges directed away from the plane of the thrust bars and lying in the vicinity of the plane of the fingers of the bracket clips.

11. A fastener as defined in claim 8, wherein the distal ends of the fingers are bent slightly rearwardly to facilitate positioning of the bracket clips on the panel.

12. A fastener as defined in claim 10, wherein the forward distal portions of each of the resilient elements is generally parallel to the bracket base and thrust bars.

13. A fastener as defined in claim 10, wherein the forward distal portions of each of the resilient elements is angled inwardly at a slightly acute angle relative to the bracket base and thrust bars.

14. A fastener as defined in claim 8, wherein the thumbs are formed as sharp prongs for digging into the side edge of the panel.

15. A fastener as defined in claim 14, wherein the thumbs form an acute angle with the bracket base.

16. A fastener for fastening a panel to a structural element having a slot-like aperture with a predetermined width, the fastener being adapted to be received in said aperture, comprising: a single piece of stiff, strong, resilient, relatively thin sheet material including:

(a) a panel edge-contacting bracket base for positioning against a side edge of the panel;

(b) a pair of spaced panel-gripping and retaining bracket clips, each formed at a respective end of the bracket base, each having a generally rectangular U-shaped configuration, the trough of the U comprising a respective end portion of the bracket base, and the legs of the U formed by a front thumb and a rear finger extending in the same sense generally perpendicularly to the plane of the bracket base, the thumbs forming an acute angle with the bracket base and being formed as sharp prongs for digging into the side edge of the panel, the bracket clips being configured and dimensioned to grip and retain the panel along a side edge thereof;

(c) a penetrator adapted for matingly thrusting into said structural element aperture, offset from the bracket base and including:

(i) thrust bar means connected to and extending generally rearwardly from and parallel to the bracket base;

(ii) a dependent resilient element continuing from the thrust bar means via reverse angled nose means, said dependent resilient element extending outwardly from the thrust bar means;

(iii) said resilient element having a free distal portion bent inwardly toward the thrust bar means; and (iv) said resilient element being configured and dimensioned so as to have a spacing therebetween, whereby said resilient element is adapted to deflect inwardly as said penetrator enters said aperture, and said penetrator upon entry into said aperture is removably retained therein.

17. A fastener for fastening a panel to a structural element having a slot-like aperture with a predetermined width, the fastener being adapted to be received in said aperture, comprising: a single piece of stiff, strong, resilient, relatively thin sheet material including:

(a) a panel edge-contacting bracket base for positioning against a side edge of the panel;

(b) a pair of spaced panel-gripping and retaining bracket clips, each formed at a respective end of the bracket base, each having a generally rectangular U-shaped configuration, the trough of the U comprising a respective end portion of the bracket base, and the legs of the U formed by a front thumb and a rear finger extending in the same sense generally perpendicularly to the plane of the bracket base, the distal ends of the fingers being bent slightly rearwardly to facilitate positioning of the bracket clips on the panel, the bracket clips being configured and dimensioned to grip and retain the panel along a side edge thereof;

(c) A penetrator adapted for matingly thrusting into said structural element aperture, offset from the bracket base and including:

(i) thrust bar means connected to and extending generally rearwardly from and parallel to the bracket base;

(ii) a dependent resilient element continuing from the thrust bar means via reverse angled nose means, said dependent resilient element extending outwardly from the thrust bar means;

(iii) said resilient element having a free distal portion bent inwardly toward the thrust bar means; and (iv) said resilient element being configured and dimensioned so as to have a spacing therebetween, whereby said resilient element is adapted to deflect inwardly as said penetrator enters said aperture, and said penetrator upon entry into said aperture is removably retained therein.

18. A fastener for fastening a panel to a structural element having a slot-like aperture with a predetermined width, the fastener being adapted to be received in said aperture, comprising:

(a) bracket means for gripping and retaining a side edge of the panel, said bracket means having a generally rectangular U-shaped configuration, the trough of the U comprising a panel edge-contacting bracket base adapted to be positioned against a side edge of the panel, and the legs of the U being adapted to grippingly engage the panel;

(b) a penetrator adapted to be matingly thrusted into said structural element aperture, offset from the bracket base and including:

(i) thrust bar means connected to and extending generally rearwardly from and parallel to the bracket base;

(ii) a pair of dependent resilient elements extending outwardly from the thrust bar means via reverse angled nose means, on opposite sides of the thrust bar means;

(iii) said dependent resilient elements each having a forward distal portion bent inwardly toward the thrust bar means; and (iv) said dependent resilient elements being configured and dimensioned so as to have a spacing therebetween, whereby said resilient elements are adapted to deflect inwardly as the penetrator enters said aperture, and said penetrator upon entry into said aperture is removably retained thereby.

19. A fastener as defined in claim 18, wherein one leg of the U is adapted to engage the rear surface of the panel.

20. A fastener as defined in claim 19, wherein said one leg of the U is formed as two spaced extended fingers one formed at each end of the bracket base.

21. A fastener as defined in claim 19, wherein the other leg of the U is formed as piercing means adapted to piercingly engaging the side edge of the panel.

22. A fastener for fastening a panel to a structural element having an aperture for receiving the fastener, comprising: a single piece of stiff, strong, resilient, relatively thin sheet material including:

(a) a bracket for grippingly engaging a side edge of the panel, the bracket having a generally rectangular, U-shaped configuration, the trough of the U being a panel edge-contacting bracket base adapted to be positioned against a side edge of the panel, and the legs of the U being adapted to grippingly engage the panel; and (b) an aperture penetrator formed as a continuation of the bracket and protruding rearwardly therefrom parallel to the bracket base, adapted for removable gripping reception by the structural element aperture, said aperture penetrator comprising spaced thrust bars and resilient elements rearwardly flared therefrom each in a different transverse sense from the thrust bars, and each resilient element being bent directly in an inward sense to reduce the amount of flare that would otherwise exist.

23. A one-piece fastener made of stiff, strong, resilient sheet material, adapted for fastening a panel to a structural element having an aperture for receiving the fastener, comprising:

(a) a bracket for grippingly engaging a side edge of the panel, the bracket having a generally rectangular, U-shaped configuration, the trough of the U being a panel edge-contacting bracket base adapted to be positioned against a side edge of the panel, and the legs of the U being adapted to grippingly engage the panel; and (b) an aperture penetrator formed as a continuation of the bracket and protruding rearwardly therefrom parallel to the bracket base, adapted for removable gripping reception by the structural element aperture, said aperture penetrator comprising spaced thrust bars and resilient elements forming a rearmost nose, the resilient elements being outwardly flared therefrom each in a different transverse sense from the trust bars, and each resilient element being bent distally in an inward sense to reduce the amount of flare that would otherwise exist, the aperture penetrator being further provided with at least one forward generally transversely orientated stop flange for limiting the extent of penetration of the aperture penetrator into the aperture.

* * * * *